US011761436B2

(12) United States Patent
Liao

(10) Patent No.: US 11,761,436 B2
(45) Date of Patent: Sep. 19, 2023

(54) PUMPING DEVICE WITH SUCTION/INJECTION FUNCTION FOR CHANGING FLUID

(71) Applicant: LIH YANN INDUSTRIAL CO., LTD., Taichung (TW)

(72) Inventor: Po-Lin Liao, Taichung (TW)

(73) Assignee: LIH YANN INDUSTRIAL CO., LTD., Taichung (TW)

( * ) Notice: Subject to any disclaimer, the term of this patent is extended or adjusted under 35 U.S.C. 154(b) by 174 days.

(21) Appl. No.: 17/407,630

(22) Filed: Aug. 20, 2021

(65) Prior Publication Data

US 2023/0055763 A1 Feb. 23, 2023

(51) Int. Cl.
*F04B 23/02* (2006.01)
*F04B 17/06* (2006.01)
*F04B 9/14* (2006.01)

(52) U.S. Cl.
CPC ..... *F04B 23/025* (2013.01); *F04B 17/06* (2013.01); *F04B 9/14* (2013.01)

(58) Field of Classification Search
CPC ..... F04B 23/025; F04B 17/06; F04B 9/14; F04B 23/02; F04B 23/026; F04B 53/12–53/129; B62B 1/16
See application file for complete search history.

(56) References Cited

U.S. PATENT DOCUMENTS 3,972,387 A * 8/1976 Braun ..... F16N 19/00 184/105.3
4,322,972 A * 4/1982 Karjala ..... G01F 25/17 137/546
4,848,659 A * 7/1989 Tadych ..... F04B 17/06 239/722
6,357,492 B1 * 3/2002 Hsu ..... B67D 7/60 141/26
10,654,503 B1 * 5/2020 Carlson ..... B62B 1/12
11,073,140 B2 * 7/2021 Chen ..... F04B 23/025
2009/0317269 A1 * 12/2009 Fronzoni ..... F04B 17/03 417/410.1
2011/0274570 A1 * 11/2011 Groeger ..... B08B 3/026 417/410.1
2015/0342401 A1 * 12/2015 Alden ..... B62B 5/0079 126/25 R
2019/0309739 A1 * 10/2019 Liao ..... F04B 9/14

* cited by examiner

*Primary Examiner* — Bryan M Lettman
(74) *Attorney, Agent, or Firm* — MUNCY, GEISSLER, OLDS & LOWE, P.C.

(57) ABSTRACT

A pumping device with suction/injection function for changing fluid. The pumping device including: a barrel; a bottom portion, connected to the barrel; a pumping mechanism, configured to drain fluid out from or inject fluid into the barrel; and at least one wheel, connected to the bottom portion so that the pumping device is easy to move. Whereby, the pumping device can be moved easily.

7 Claims, 11 Drawing Sheets

PUMPING DEVICE WITH SUCTION/INJECTION FUNCTION FOR CHANGING FLUID

BACKGROUND OF THE INVENTION

Field of the Invention

The present invention relates to a pumping device.

Description of the Prior Art

Generally speaking, in fluid-changing, such as to replace fuel or oil of vehicles, a pumping device with a suction/injection function is often used to suck out the old fluid and then inject new fluid into the vehicle. The pumping device can be roughly classified into portable and landing types according to its use and appearance. Generally, after the storage tank of the pumping device is filled with fluid, the overall weight becomes heavier. To move the pumping device, the pumping device needs to be lifted off the ground, which results in hard and unstable movement of the pumping device and overturning of the fluid.

The present invention is, therefore, arisen to obviate or at least mitigate the above-mentioned disadvantages.

SUMMARY OF THE INVENTION

The main object of the present invention is to provide a pumping device which is easy to move.

To achieve the above and other objects, a pumping device is provided, including: a barrel; a bottom portion, connected to the barrel; a pumping mechanism, configured to drain fluid out from or into the barrel; and at least one wheel, connected to the bottom portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
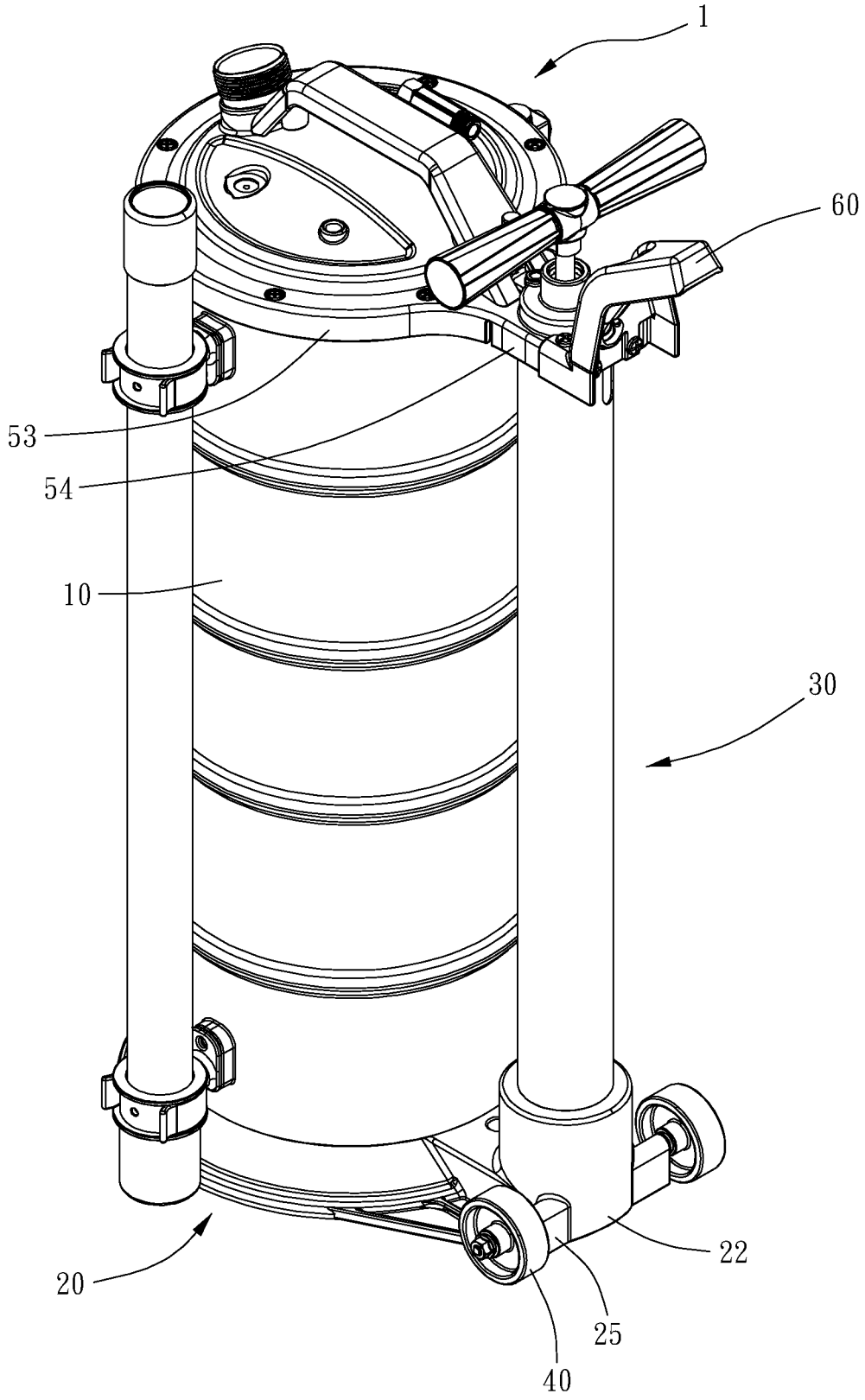
FIG. 1 is a stereogram of a preferable embodiment of the present invention.
Figure 2:
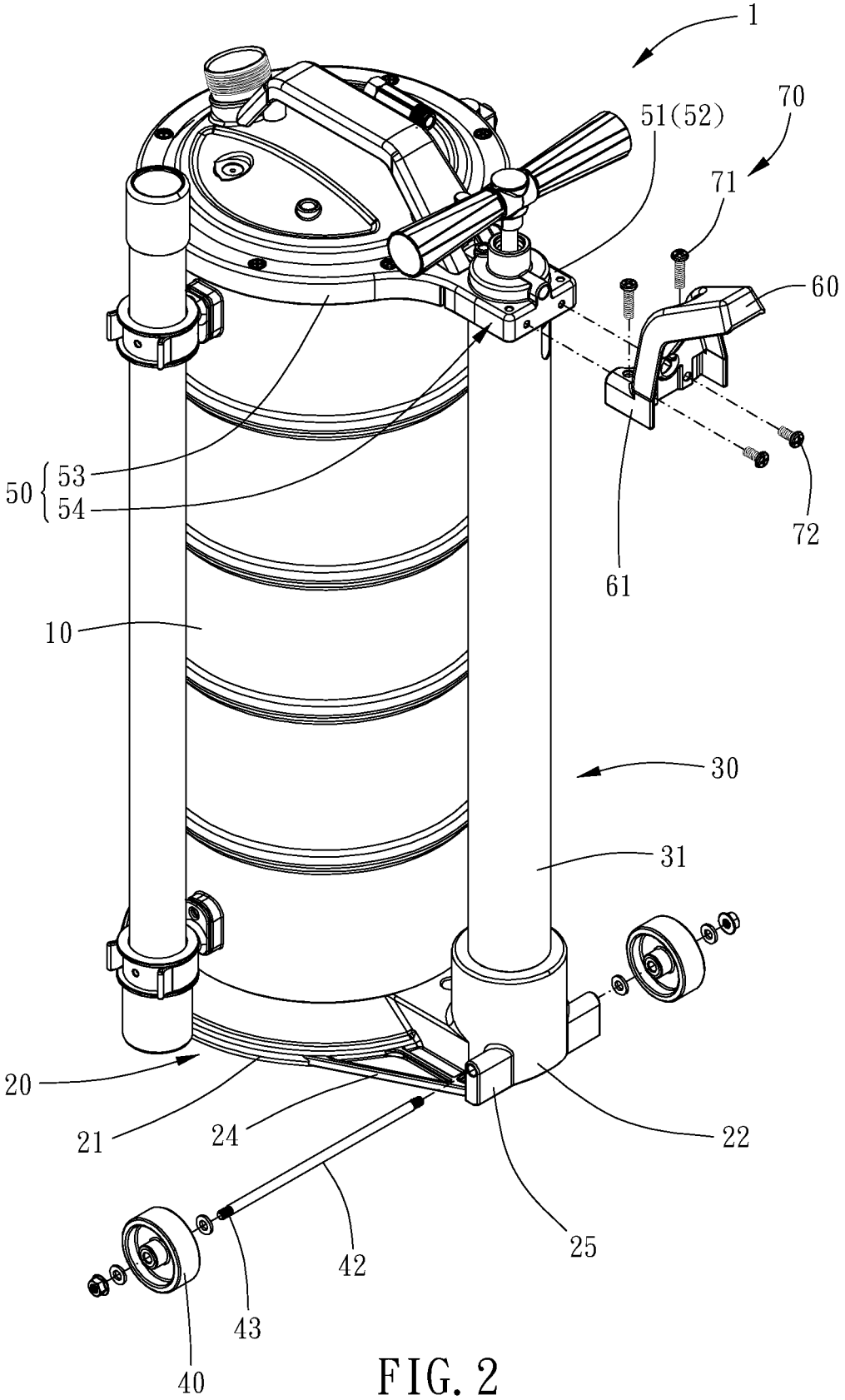
FIG. 2 is a breakdown drawing of a preferable embodiment of the present invention.
Figure 3:
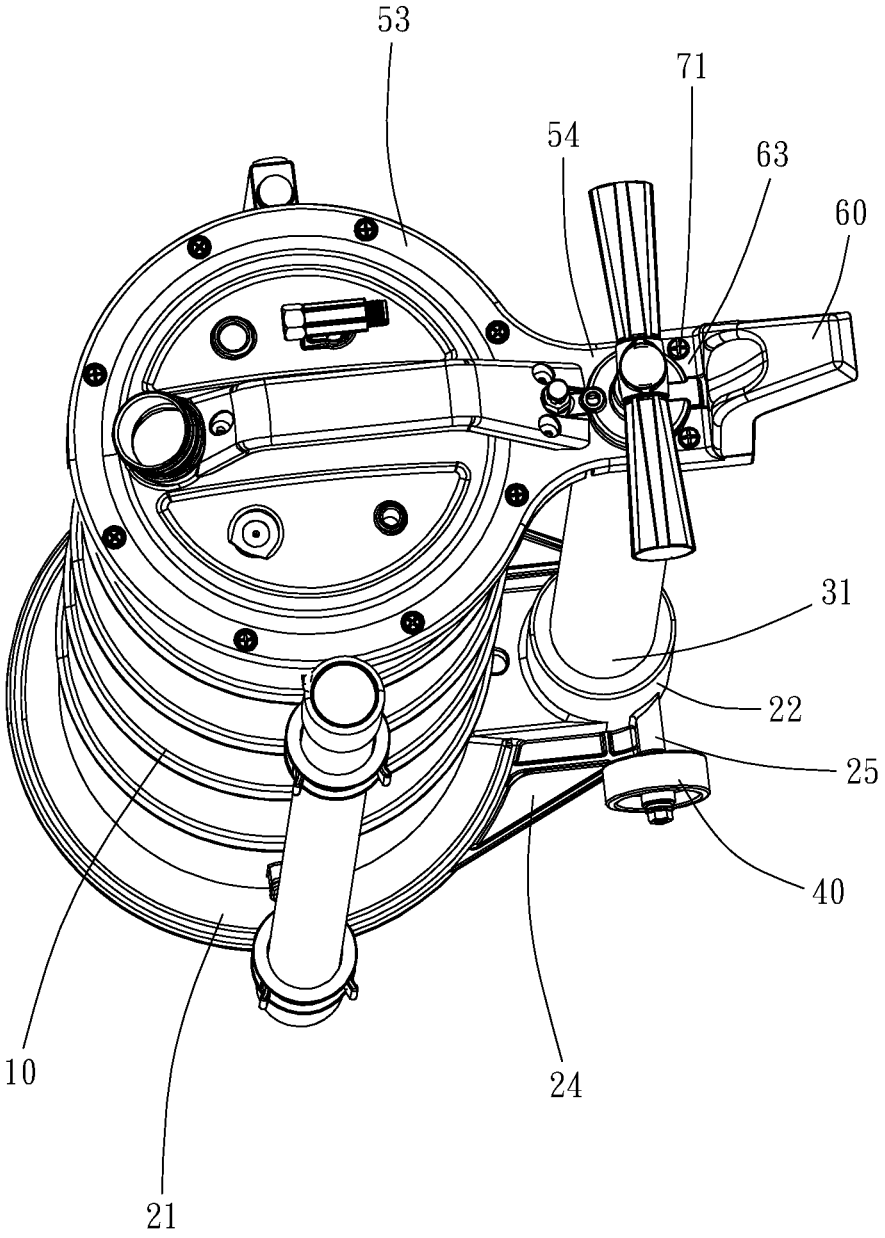
FIG. 3 is a top view of a preferable embodiment of the present invention.
Figure 4:
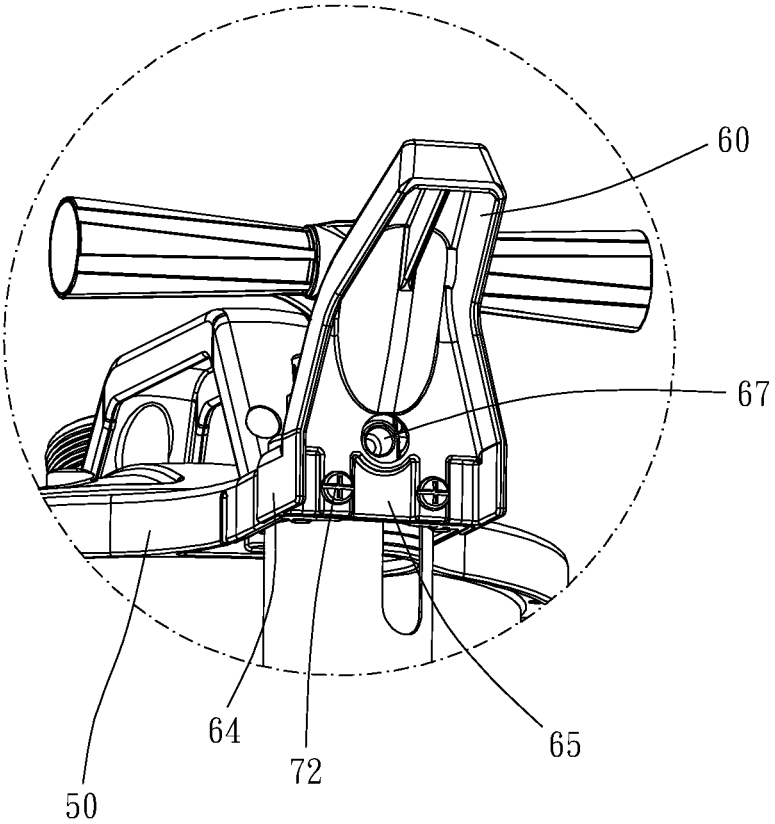
FIG. 4 is a partial enlargement of a preferable embodiment of the present invention.
Figure 5:
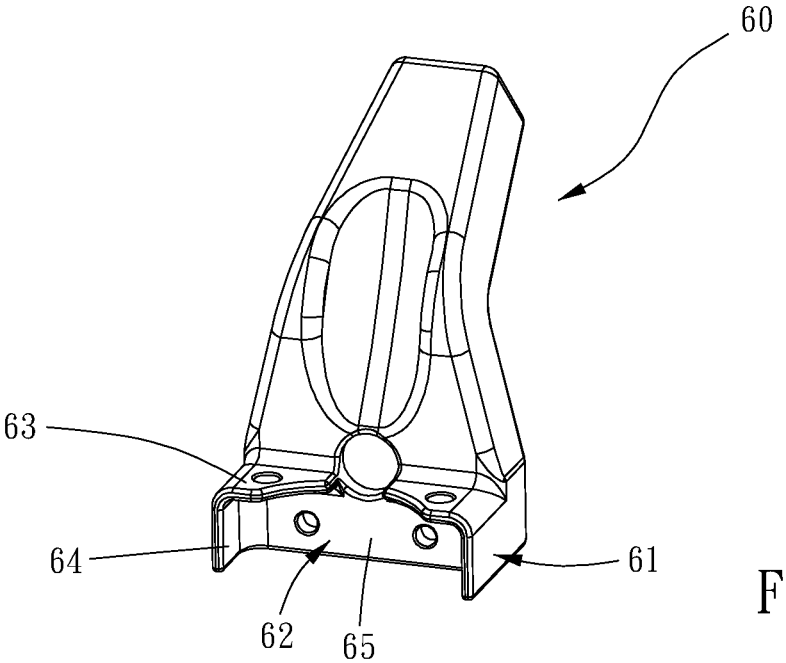
FIG. 5 is a stereogram of a grip of a preferable embodiment of the present invention.
Figure 6:
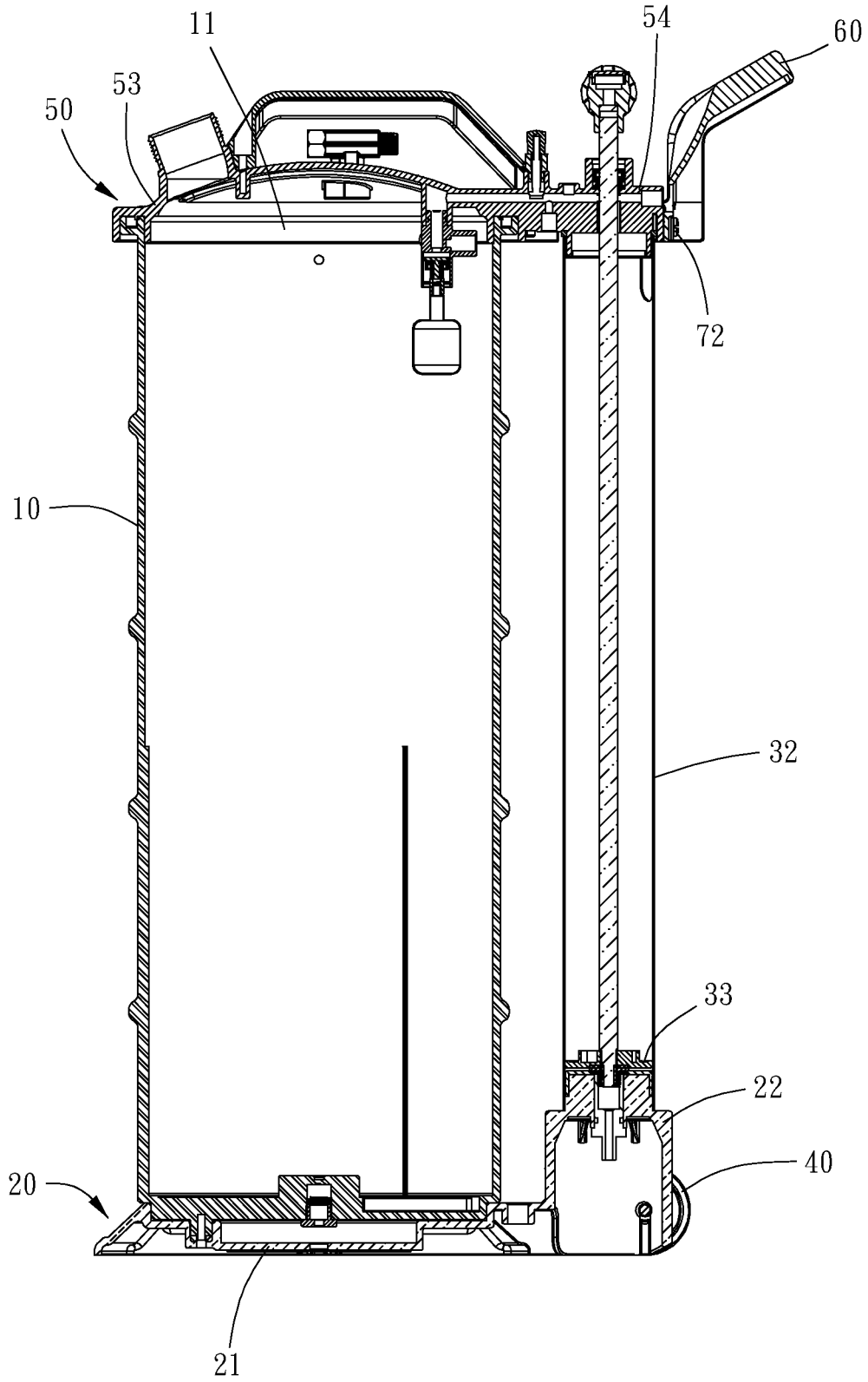
FIG. 6 is a cross-sectional view of a preferable embodiment of the present invention.

Please refer to FIGS. 1 to 12 for a preferable embodiment of the present invention. A pumping device 1 of the present invention includes a barrel 10, a bottom portion 20, a pumping mechanism 30 and at least one wheel 40.

The bottom portion 20 is connected to the barrel 10; the pumping mechanism 30 is configured to drain fluid out from or into the barrel 10; each of the at least one wheel 40 is connected to the bottom portion 20 so that the pumping device 1 is easy to move. In this embodiment, the bottom portion 20 and the barrel 10 are detachably connected; however, the bottom portion 20 and the barrel 10 may be integrally formed of one piece.

Figure 7:
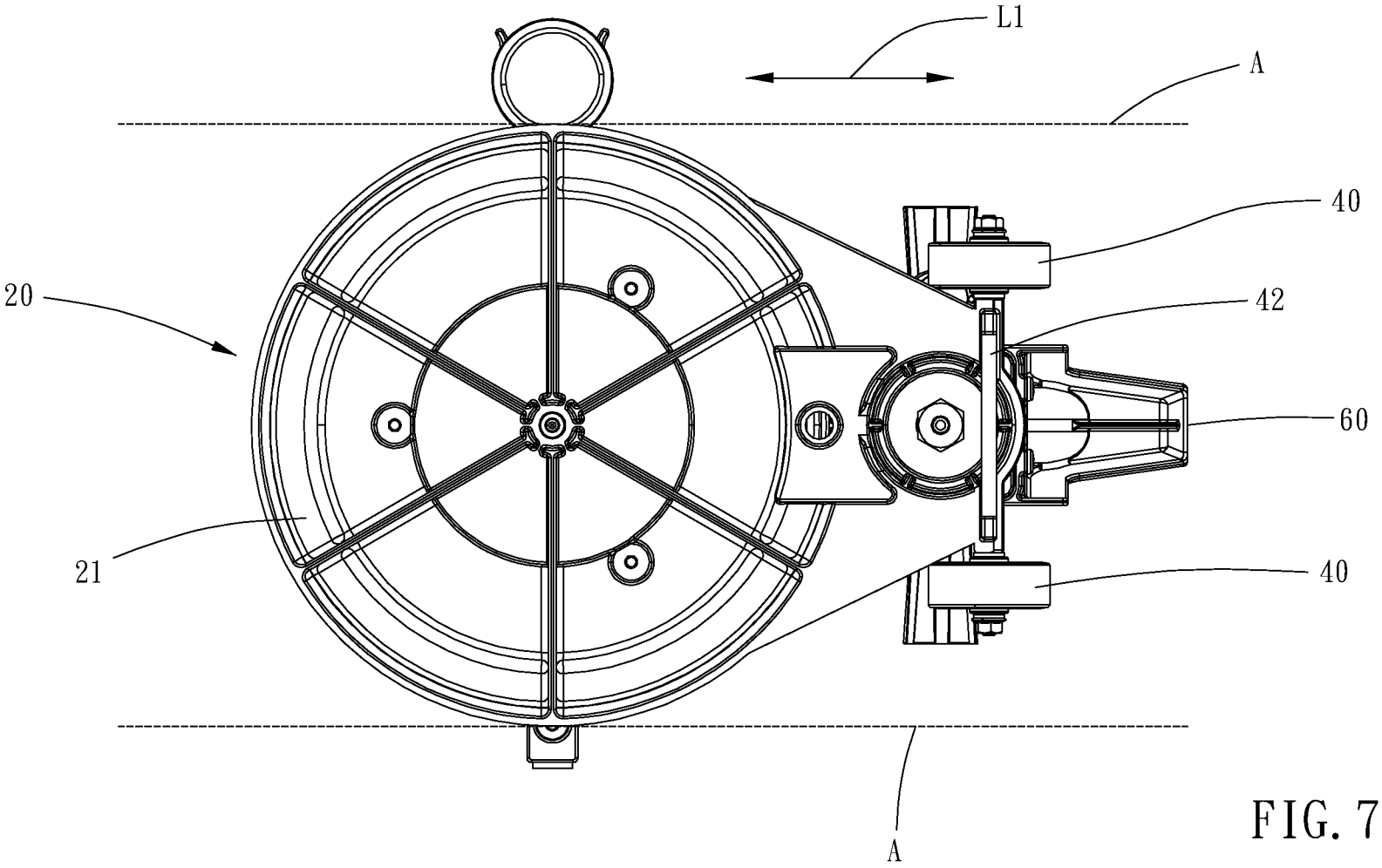
FIG. 7 is a bottom view of a preferable embodiment of the present invention.

The pumping mechanism 30 includes a pump 31, the pump 31 has an outer diametric dimension smaller than an outer diametric dimension of the barrel 10. The bottom portion 20 includes a first base portion 21 and a second base portion 22, the barrel 10 is connected with the first base portion 21, the pump 31 is located outside the second base portion 22, and each of the at least one wheel 40 is connected with the second base portion 22. Specifically, the pump 31 includes a tubular body 32 and a piston 33 movably disposed in the tubular body 32. The second base portion 22 has an outer diametric dimension larger than an outer diametric dimension of the tubular body 32 and smaller than an outer diametric dimension of the first base portion 21. Preferably, the first base portion 21 and the second base portion 22 are connected in a lateral direction L1. As viewed in a direction from the bottom portion 20 toward the barrel 10 (as shown in FIG. 7), the first base portion 21 has an outer diametric dimension larger than an outer diametric dimension of the barrel 10; two tangent lines A tangent to two points diametrically located on an outer contour of the first base portion 21 are parallel to the lateral direction, and each of the at least one wheel 40 is located between the two tangent lines A, so that the pumping device 1 is easy to move.

Figure 8:
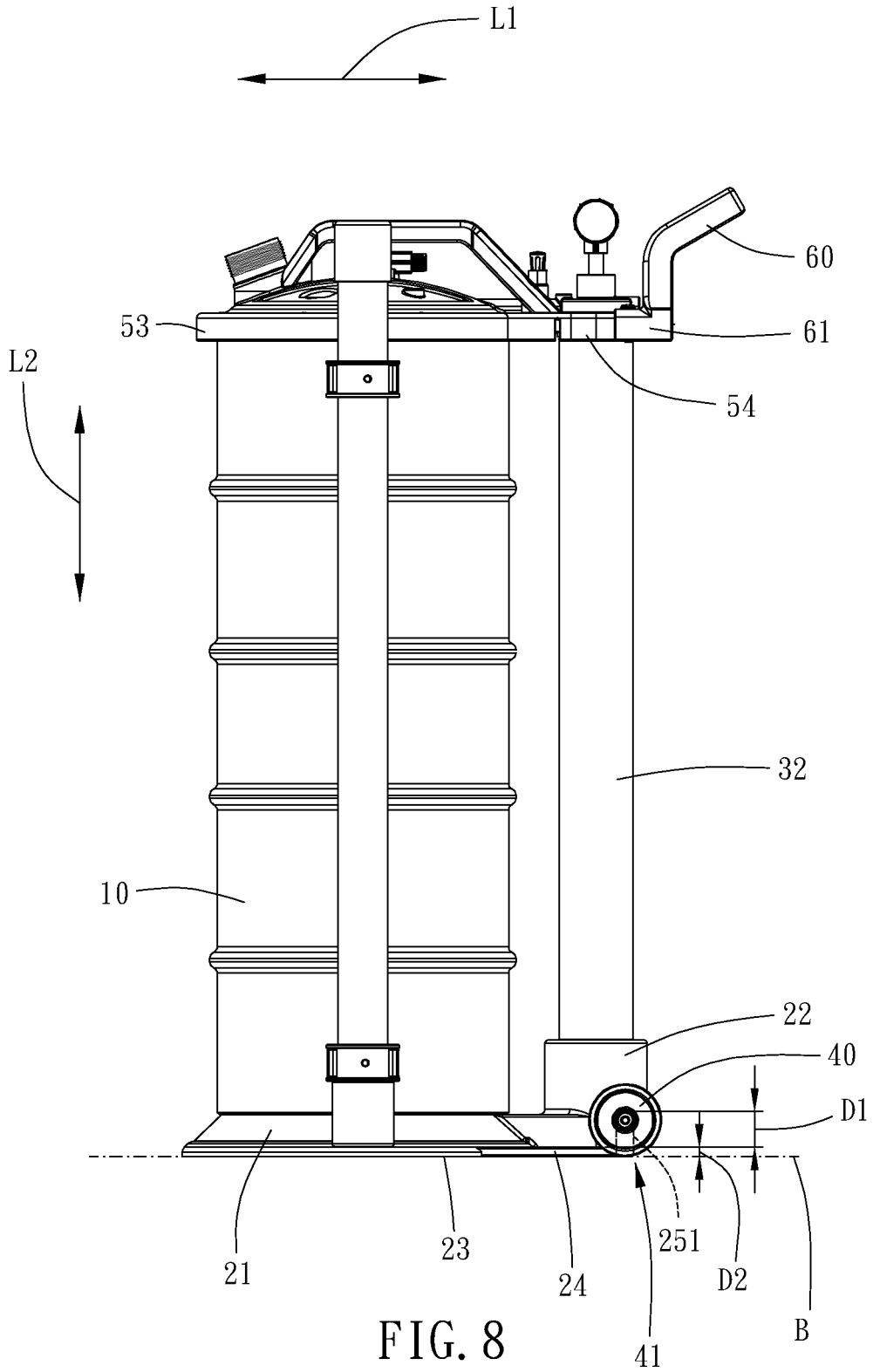
FIG. 8 is a side view of a preferable embodiment of the present invention.
Figure 9:
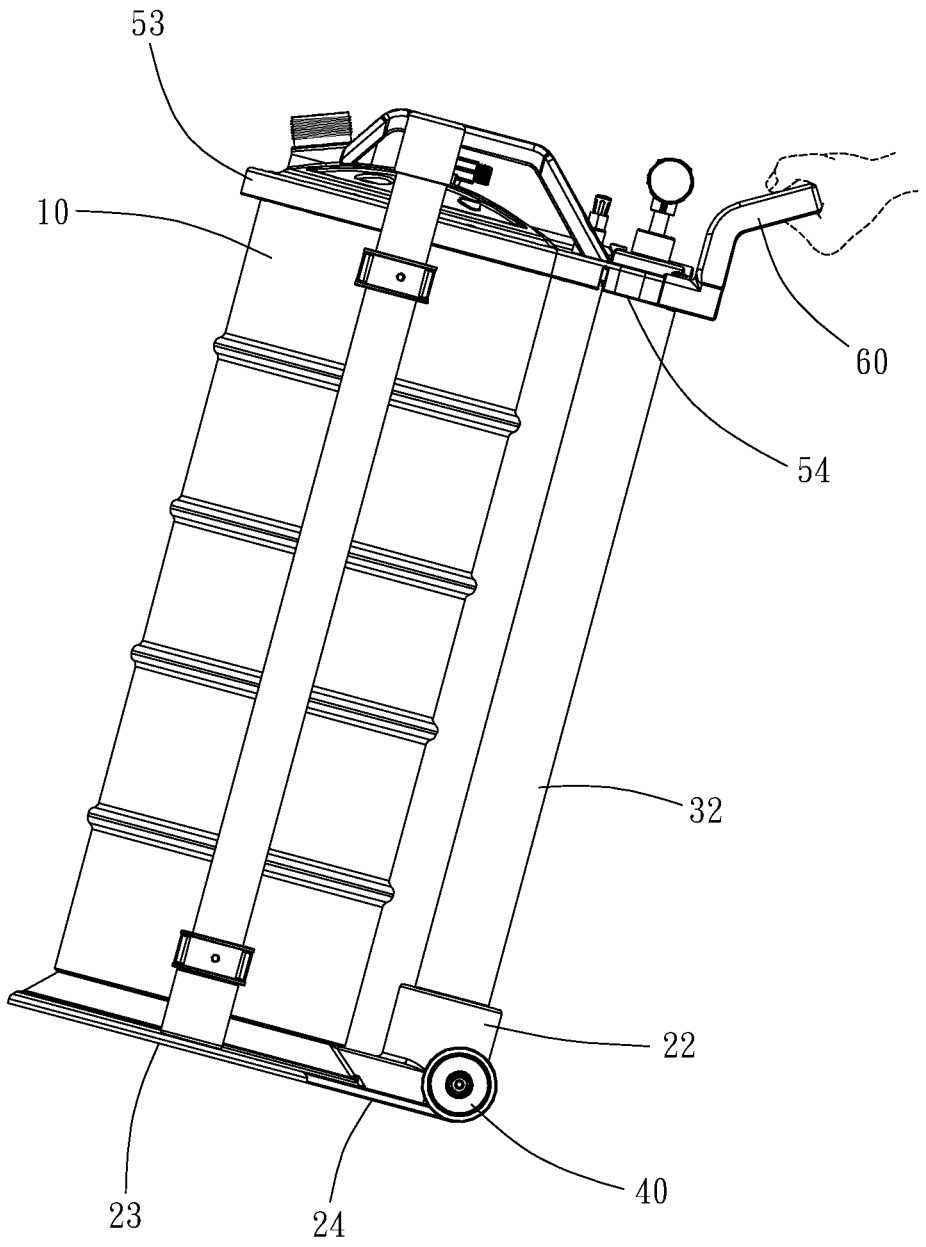
FIG. 9 is a drawing showing operation of a preferable embodiment of the present invention.
Figure 10:
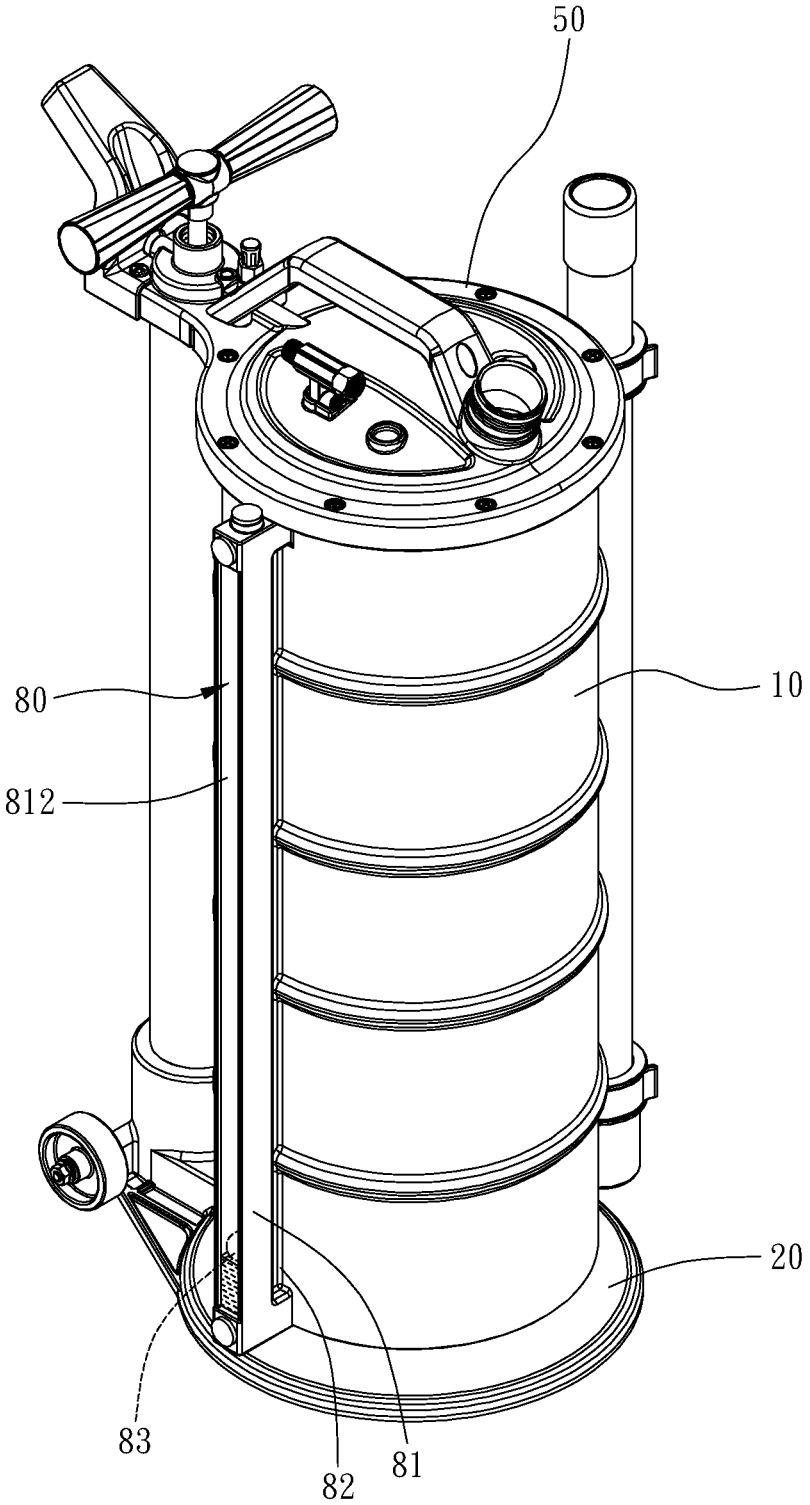
FIG. 10 is another stereogram of a preferable embodiment of the present invention.
Figure 11:
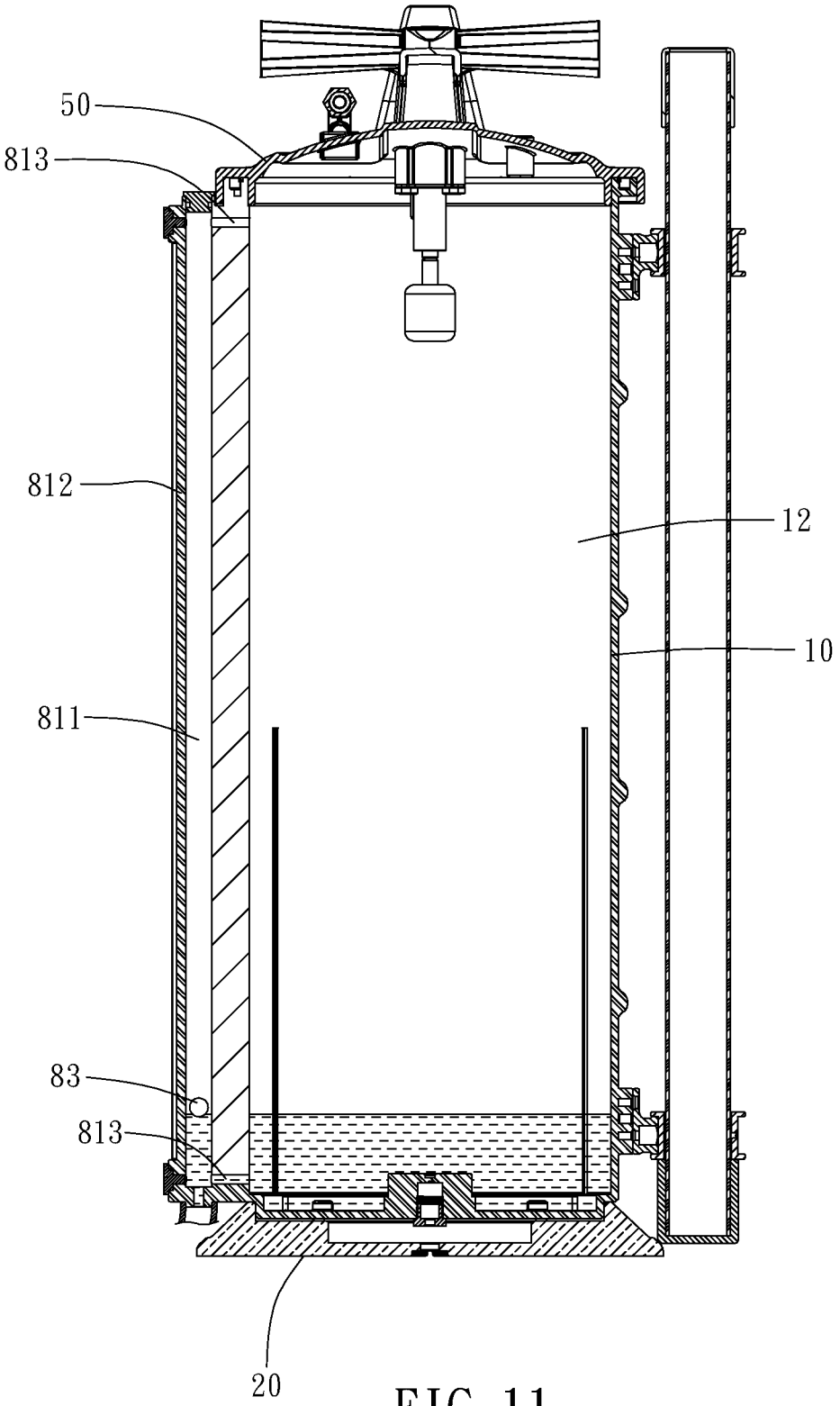
FIG. 11 is another cross-sectional view of a preferable embodiment of the present invention.
Figure 12:
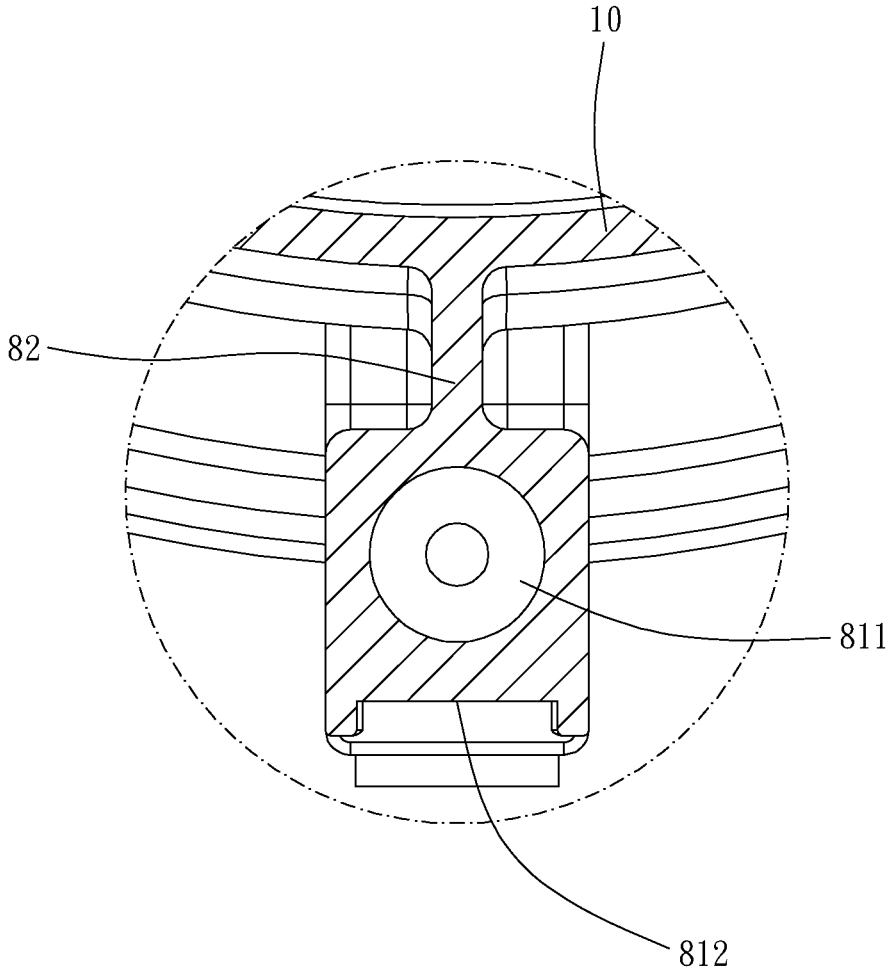
FIG. 12 is a partial cross-sectional view of a preferable embodiment of the present invention.

The bottom portion 20 includes a bottom face 23, and the barrel 10 and the bottom portion 20 are arranged on a longitudinal direction L2; as viewed in a direction lateral to the longitudinal direction (as shown in FIG. 8), an extent B of the bottom face 23 is tangent to the at least one wheel 40, so that the bottom face 23 and each of the at least one wheel 40 can contact a supporting face (such as the ground) when the pumping device 1 is in a upright manner, which is stable.

The bottom portion 20 further includes at least one wing portion 25, the at least one wing portion 25 projects from the second base portion 22, the at least one wheel 40 is rotatably connected to the at least one wing portion 25. In this embodiment, the bottom portion 20 further includes a plurality of wing portions 25, the plurality of wing portions 25 project from opposing sides of the second base portion 22, the pumping device 1 includes a plurality of wheels 40, and each of the at least one wheel 40 is rotatably connected to one of a the wing portion 25. Preferably, the longitudinal direction L2 is lateral to the lateral direction L1, and each of the plurality of wing portions 25 is lateral to the longitudinal direction L2 and the lateral direction L1 and projects from the second base portion 22, so that each of the plurality of wing portions 25 and each of the at least one wheel 40 provide good support. Preferably, each of the plurality of wing portions 25 includes a bottom side 251, the bottom side 251 of each of the plurality of wing portions 25 is aligned with the bottom face 23 of the bottom portion 20, and each of the plurality of wing portions 25 is configured to contact the supporting face.

The bottom portion 20 further includes at least one rib 24, and each of the at least one rib 24 is connected with and between the at least one wing portion 25, the first base portion 21 and the second base portion 22. In this embodiment, the bottom portion 20 includes a plurality of ribs 24, which enforces the structural strength of the first base portion 21 and the second base portion 22.

The pumping device 1 further includes a cover 50 and a grip 60, the barrel 10 includes an opening 11, the cover 50 covers the opening 11, and the grip 60 is connected to the cover 50. Preferably, the grip 60 is detachably connected to the cover 50, the cover 50 includes a first assembling portion 51, the grip 60 includes a second assembling portion 61, one of the first assembling portion 51 and the second assembling portion 61 includes an engaging slot 62, and the other of the first assembling portion 51 and the second assembling portion 61 includes a projection 52 detachably engaged within the engaging slot 62. In this embodiment, the first assembling portion 51 includes the projection 52, the second assembling portion 61 includes the engaging slot 62, and the grip 60 is replaceable and stably connected with and the cover 50. The pumping device 1 further includes a connecting assembly 70, and the connecting assembly 70 includes at least one first connection member 71 and at least one second connection member 72. In this embodiment, the connecting assembly 70 includes a plurality of first connection members 71 and a plurality of second connection members 72, and each of the at least one first connection member 71 and each of the at least one second connection member 72 are screw (however, may be other fastener or the like). Each of the at least one first connection member 71 and each of the at least one second connection member 72 are respectively connected with the first assembling portion 51 and the second assembling portion 61. Preferably, a direction in which each of the at least one first connection member 71 is inserted within the first assembling portion 51 and the second assembling portion 61 is lateral to a direction in which each of the at least one second connection member 72 is inserted within the first assembling portion 51 and the second assembling portion 61. Specifically, the first assembling portion 51 includes the projection 52, and the second assembling portion 61 includes a top wall 63, two side walls 64 lateral to the top wall 63, and a rear wall 65 laterally connected with and between the top wall 63 and the two side walls 64; the two side walls 64, the top wall 63 and the rear wall 65 define the engaging slot 62; each of the at least one first connection member 71 is screwed to the top wall 63 and the first assembling portion 51, and each of the at least one second connection member 72 is screwed to the rear wall 65 and the first assembling portion 51. In this embodiment, each of the at least one first connection member 71 is perpendicular to one of the at least one second connection member 72, which provides good structural strength of the cover 50 and the grip 60. The grip 60 includes an assembling hole 67 configured to correspond to the pumping mechanism 30 a through hole in communication with the interior of the barrel 10.

In the longitudinal direction L2, each of the plurality of wing portions 25 has a longitudinal extent D1 larger than a longitudinal extent D2 of each of the at least one rib 24. The bottom portion 20 further includes an axle 42 disposed through the plurality of wing portions 25 and the second base portion 22, and the plurality of wheels 40 is rotatably disposed at opposing ends of the axle 42. The axle 42 is located higher than each of the at least one rib 24 relative to the bottom face 23 of the bottom portion 20, which is advantageous for tilting of the barrel 10 for easy movement.

The cover 50 includes a first cover portion 53 and a second cover portion 54 projecting from the first cover portion 53, the first cover portion 53 covers the opening 11 of the barrel 10, and the tubular body 32 is disposed between the second cover portion 54 and the second base portion 22. The second cover portion 54 includes the second assembling portion 61, and the grip 60 and the first cover portion 53 are disposed at opposing sides of the second cover portion 54 for easy grip and easy tilting of the pumping device 1.

The pumping device 1 further includes a level observation portion 80, the level observation portion 80 is disposed on a side of the barrel 10, and the level observation portion 80 includes a reservoir 81 and a connecting portion 82. The connecting portion 82 is connected between the reservoir 81 and the barrel 10, and the reservoir 81 includes a receiving chamber 811 and a pervious portion 812 corresponding to the receiving chamber 811. In this embodiment, the pervious portion 812 is made of transparent material. The receiving chamber 811 is in communication with a storing room 12 of the barrel 10, and the storing room 12 is configured to store fluid (such as oil, water or the like. Preferably, the level observation portion 80 further includes a floatable member 83, and the floatable member 83 is movably disposed in the receiving chamber 811; the reservoir 81 further includes two channels 813 arranged in interval, each of the two channels 813 is in communication with the receiving chamber 811 and the storing room 12. Whereby, the level of the fluid in the barrel can be obtained easily by viewing the level observation portion 80.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pumping device, including:

a barrel;

a bottom portion, connected to the barrel;

a pumping mechanism, configured to drain fluid out from or into the barrel; and at least one wheel, connected to the bottom portion;

wherein the pumping mechanism includes a pump, the pump has an outer diametric dimension smaller than an outer diametric dimension of the barrel, the bottom portion includes a first base portion and a second base portion, the barrel is connected with the first base portion, the pump is located outside the barrel and connected with the second base portion, and each of the at least one wheel is connected with the second base portion.

2. The pumping device of claim 1, wherein the first base portion and the second base portion are connected in a lateral direction; as viewed in a direction from the bottom portion toward the barrel, the first base portion has an outer diametric dimension larger than an outer diametric dimension of the barrel, two tangent lines tangent to two points diametrically located on an outer contour of the first base portion are parallel to the lateral direction, and each of the at least one wheel is located between the two tangent lines.

3. The pumping device of claim 1, wherein the bottom portion further includes at least one wing portion, the at least one wing portion projects from the second base portion, and the at least one wheel is rotatably connected to the at least one wing portion.

4. The pumping device of claim 3, wherein the bottom portion further includes at least one rib, and each of the at least one rib is connected with and between the at least one wing portion, the first base portion and the second base portion.

5. The pumping device of claim 1, further including a level observation portion, wherein the level observation portion is disposed on a side of the barrel, the level observation portion includes a reservoir and a connecting portion, the connecting portion is connected between the reservoir and the barrel, the reservoir includes a receiving chamber and a pervious portion corresponding to the receiving chamber, and the receiving chamber is in communication with a storing room of the barrel.

6. The pumping device of claim 1, wherein the bottom portion includes a bottom face, the barrel and the bottom portion are arranged in a longitudinal direction of the barrel; as viewed in a direction lateral to the longitudinal direction, an imaginary line passing through an extent of the bottom face is tangent to the at least one wheel.

7. A pumping device, including:

a barrel;

a bottom portion, connected to the barrel;

a pumping mechanism, configured to drain fluid out from or into the barrel; and at least one wheel, connected to the bottom portion;

a cover and a grip, wherein the barrel includes an opening, the cover covers the opening of the barrel, and the grip is connected to the cover;

wherein the grip is detachably connected to the cover, the cover includes a first assembling portion, the grip includes a second assembling portion, one of the first assembling portion and the second assembling portion includes an engaging slot, and the other of the first assembling portion and the second assembling portion includes a projection detachably engaged within the engaging slot;

wherein the pumping mechanism includes a pump, the pump has an outer diametric dimension smaller than an outer diametric dimension of the barrel, the bottom portion includes a first base portion and a second base portion, the barrel is connected with the first base portion, the pump is located outside the barrel and connected with the second base portion, and each of the at least one wheel is connected with the second base portion; the first base portion and the second base portion are connected in a lateral direction; as viewed in a direction from the bottom portion toward the barrel, the first base portion has an outer diametric dimension larger than an outer diametric dimension of the barrel, two tangent lines tangent to two points diametrically located on an outer contour of the first base portion are parallel to the lateral direction, and each of the at least one wheel is located between the two tangent lines; the bottom portion further includes a plurality of wing portions, the plurality of wing portions project from opposing sides of the second base portion, the at least one wheel includes a plurality of wheels, each of the plurality of wheels is rotatably connected to one of the two wing portions; the bottom portion further includes a bottom face, the barrel and the bottom portion are connected in a longitudinal direction; as view in the lateral direction, an extent of the bottom face is tangent to the at least one wheel; each of the plurality of wing portions includes a bottom side, the bottom side of each of the plurality of wing portions is aligned with the bottom face of the bottom portion; the pump includes a tubular body and a piston movably disposed in the tubular body; the second base portion has an outer diametric dimension larger than an outer diametric dimension of the tubular body and smaller than an outer diametric dimension of the first base portion; the longitudinal direction is lateral to the lateral direction, each of the plurality of wing portions is lateral to the longitudinal direction and the lateral direction and projects from the second base portion; the bottom portion further includes at least one rib; in the longitudinal direction, each of the plurality of wing portions has a longitudinal extent larger than a longitudinal extent of each of the at least one rib, the bottom portion further includes an axle disposed through the plurality of wing portions and the second base portion, the plurality of wheels are rotatably disposed at opposing ends of the axle, and the axle is located higher than each of the at least one rib relative to the bottom face of the bottom portion; the cover includes a first cover portion and a second cover portion projecting from the first cover portion, the first cover portion covers the opening of the barrel, the tubular body is disposed between the second cover portion and the second base portion, the second cover portion includes the second assembling portion, and the grip and the first cover portion are disposed at opposing sides of the second cover portion; the first assembling portion includes the projection, and the second assembling portion includes a top wall, two side walls lateral to the top wall, and a rear wall laterally connected with and between the top wall and the two side walls, the two side walls; the top wall and the rear wall define the engaging slot; the pumping device further includes a connecting assembly, the connecting assembly includes at least one first connection member and at least one second connection member, each of the at least one first connection member is screwed to the top wall and the first assembling portion, and each of the at least one second connection member is screwed to the rear wall and the first assembling portion; each of the at least one first connection member and each of the at least one second connection member are respectively connected with the first assembling portion and the second assembling portion; a direction in which each of the at least one first connection member is inserted within the first assembling portion and the second assembling portion is lateral to a direction in which each of the at least one second connection member is inserted within the first assembling portion and the second assembling portion; the connecting assembly includes a plurality of first connection members and a plurality of second connection members; the pumping device further includes a level observation portion, the level observation portion is disposed on a side of the barrel, the level observation portion includes a reservoir and a connecting portion, the connecting portion is connected between the reservoir and the barrel, the reservoir includes a receiving chamber and a pervious portion corresponding to the receiving chamber, and the receiving chamber is in communication with a storing room of the barrel; the level observation portion further includes a floatable member, and the floatable member is movably disposed in the receiving chamber; the reservoir further includes two channels arranged in interval, and each of the two channels is in communication with the receiving chamber and the storing room.

* * * * *